United States Patent [19]

Emery

[11] 4,269,345

[45] May 26, 1981

[54] NESTABLE MOULDED CONTAINER

[76] Inventor: Roy W. Emery, 1 Donino Ct., Toronto, Ontario, Canada, M4N 2H6

[21] Appl. No.: 65,462

[22] Filed: Aug. 10, 1979

[51] Int. Cl.[3] ..... B65D 1/18

[52] U.S. Cl. ..... 229/2.5 R; 206/515

[58] Field of Search ..... 206/515, 518, 519; 229/DIG. 11, 2.5, 32

[56] References Cited

U.S. PATENT DOCUMENTS

| | | | |
|---|---|---|---|
| 1,124,875 | 1/1915 | Dishmaker | 229/DIG. 11 |
| 2,513,693 | 7/1950 | Turbyfill | 206/519 X |
| 2,762,548 | 9/1956 | Van Dyke | 229/2.5 |
| 2,762,549 | 9/1956 | Van Dyke | 229/2.5 |
| 2,822,119 | 2/1958 | Van Dyke | 229/2.5 X |
| 2,865,547 | 12/1958 | Van Dyke | 229/2.5 |
| 2,872,093 | 3/1959 | Chaplin | 229/2.5 |
| 3,580,484 | 5/1971 | Schneider | 229/2.5 X |
| 3,765,976 | 10/1973 | Nasica | 229/32 |
| 3,901,406 | 8/1975 | Kivett | 206/515 |

FOREIGN PATENT DOCUMENTS

| | | | |
|---|---|---|---|
| 75383 | 5/1961 | France | 229/DIG. 11 |

*Primary Examiner*—Davis T. Moorhead

*Attorney, Agent, or Firm*—Fetherstonhaugh & Co.

[57] ABSTRACT

This invention relates to a moulded container which comprises at least two container portions, each consisting of a bottom wall segment and a side wall, each side wall being integrally moulded with its associated bottom wall segment and retained in an upstanding relationship with respect thereto, the bottom wall segments being interconnected to form a bottom wall of the container, each bottom wall segment being connected with respect to the remainder of said bottom wall in a manner to permit flexing of the bottom wall whereby said moulded container may be moulded with said container portions disposed in a first configuration in which said bottom wall segments are inclined with respect to one another to dispose the side walls in a position facilitating removal from a mould and subsequent nesting of the containers and thereafter said bottom wall segments may be hinged along each hinge line to a container configuration.

1 Claim, 4 Drawing Figures

NESTABLE MOULDED CONTAINER

FIELD OF INVENTION

This invention relates to moulded containers. In particular, this invention relates to a moulded container which has a bottom wall and side walls which are retained in an upstanding configuration with respect to the bottom wall and wherein the bottom wall is flexible along at least one flex line to facilitate moulding and nesting of the containers.

PRIOR ART

In the manufacture of moulded containers, the side walls are formed integrally with the bottom wall and are retained in a fixed relationship with respect to the bottom wall. When the containers are to be stacked one on top of the other in use, it is customary to mould the containers with the side walls extending vertically from the bottom wall so that in a stack the side walls of the containers can be vertically aligned to provide vertical stacking strength. As a result of the fact that the side walls are vertically oriented, it is not possible to nest these containers to minimize the shipping and storage space occupied by the containers when empty. When stacking strength is not important, the side walls of a moulded container may be angularly inclined with respect to the bottom wall to facilitate unmoulding in manufacture and the nesting of the containers during shipping and storage of the empty containers.

Because of the above limitations associated with the structure of conventional moulded containers many industries prefer to use containers which may be erected from knock-down paperboard blanks and the like. Such containers may be knocked down to a compact configuration for shipping and erected to provide vertically oriented side walls for stacking strength in use. Knock-down paperboard containers are, however, generally more expensive to manufacture and assemble than are moulded containers and are more wasteful of paperboard material because of the amount of scrap material formed in the manufacture of the required blank.

SUMMARY OF INVENTION

The present invention overcomes the difficulties of the prior art described above with respect to moulded containers while providing a moulded container which has the adaptability of a knock-down paperboard container in that it provides vertical stacking strength when in the container configuration and a nesting configuration which permits the compact nesting of a plurality of like containers.

According to one aspect of the present invention, there is provided a moulded container which comprises at least two container portions, each consisting of a bottom wall segment and a side wall, each side wall being integrally moulded with its associated bottom wall segment and retained in an upstanding relationship with respect thereto, the bottom wall segments being interconnected to form a bottom wall of the container, each bottom wall segment being hingedly connected with respect to the remainder of said bottom wall along a hinge line disposed therebetween whereby said moulded container may be moulded with said container portions disposed in a first configuration in which said bottom wall segments are inclined with respect to one another to dispose the side walls in a position facilitating removal from a mould and subsequent stacking of the containers and thereafter said bottom wall segments may be hinged along each hinge line to a container configuration.

PREFERRED EMBODIMENT

The invention will be more clearly understood after reference to the following detailed specification read in conjunction wih the drawings, wherein FIG. 1 is a pictorial view of a moulded container constructed in accordance with an embodiment of the present invention.

Figure 1:
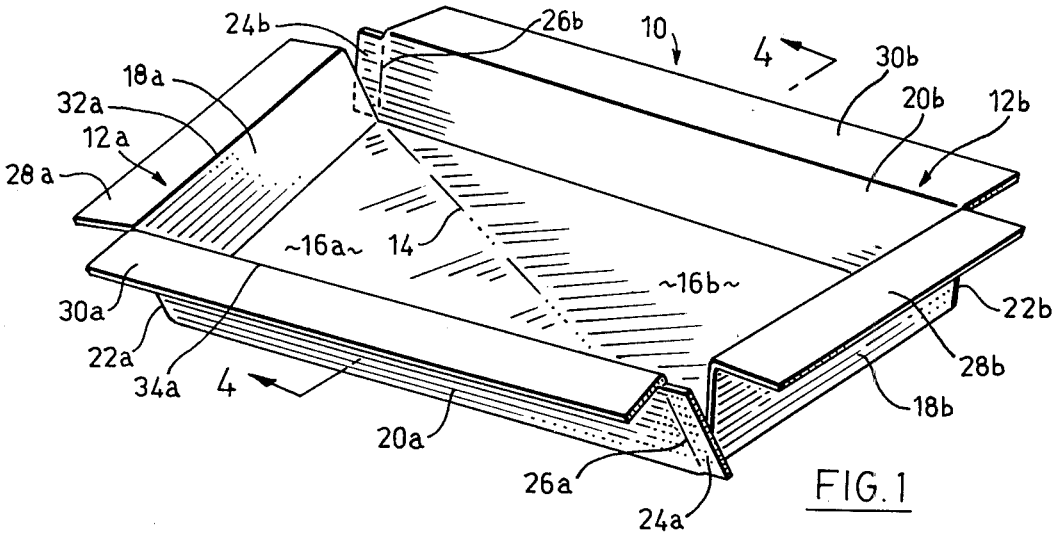
Figure 2:
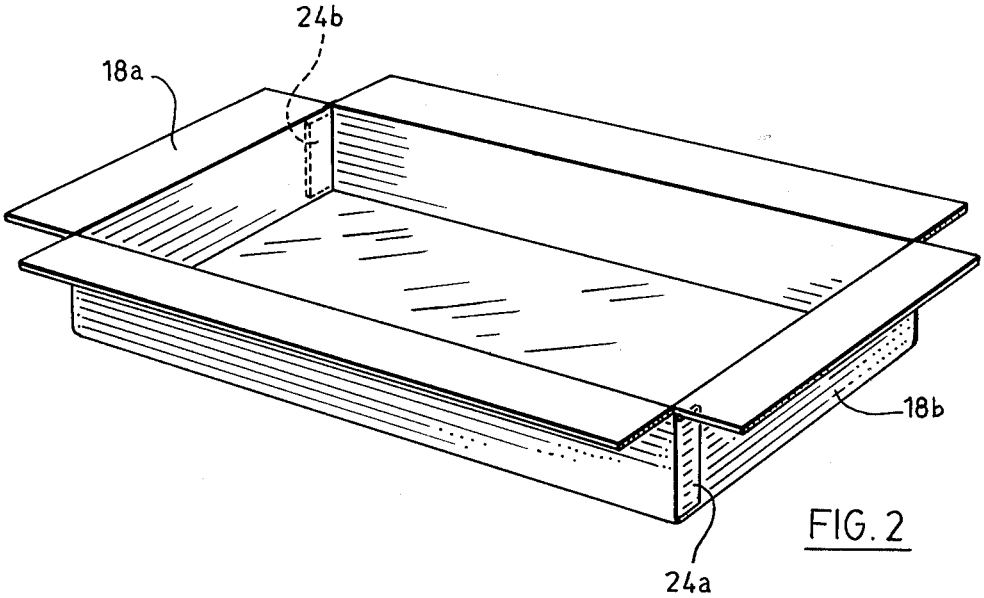
FIG. 2 is a pictorial view of the container of FIG. 1 showing the container in an assembled configuration.
Figure 3:
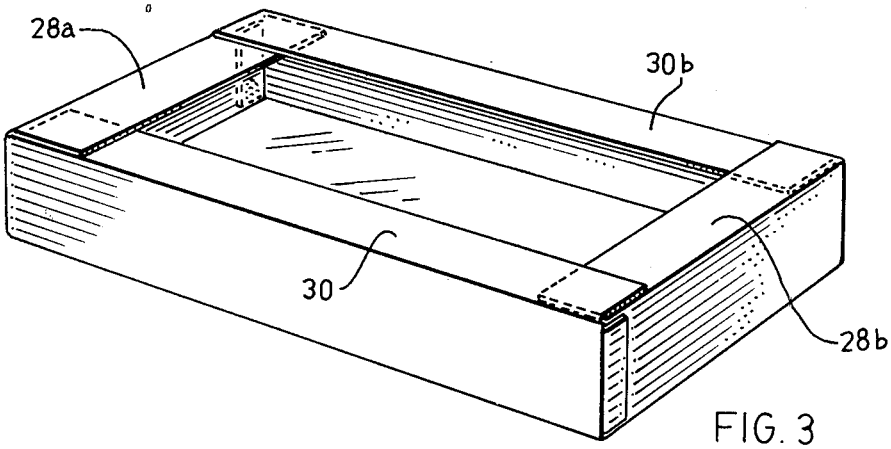
FIG. 3 is a pictorial view similar to FIG. 2 showing the top flaps of the container in the closed configuration.

With reference to FIGS. 1 to 3 of the drawings, the reference numeral 10 refers generally to a moulded container which is in the form of a unitary body and which consists of container portions 12*a* and 12*b* connected to one another so as to flex or hinge along a line 14 which extends diagonally across the bottom wall of the container and sub-divides the bottom wall into bottom wall segments 16*a* and 16*b*. The bottom wall of the container may be sufficiently flexible to permit flexing along the line 14 or it may be weakened along the line 14 to permit flexing or hinging. The container portion 12*a* has side walls 18*a* and 20*a* upstanding from the bottom wall segment 16*a* and connected to one another along the edge 22*a*. A locking tab 24*a* projects outwardly from the free end of the side wall 20*a* and is connected thereto along hinge line 26*a*. Top cover flanges 28*a* and 30*a* are hingedly connected to the side walls 18*a* and 22*a* respectively along hinge lines 32*a* and 34*a*. The container portion 12*b* is constructed by the same components as the container portion 12*a* with like numerals being applied to identify these components with the suffix "b" replacing the suffix "a".

In the embodiment illustrated in FIGS. 1 to 3, the side walls 18*a* and 20*a* extend perpendicularly from the bottom wall section 16*a* and the side walls 18*b* and 20*b* extend perpendicularly from the bottom wall section 16*b*. The side walls are retained in a perpendicular relationship with respect to their associated bottom wall section by reason of the fact that each section is moulded as a unitary body. By providing that the side walls of the container are discontinuous, it is possible to flex or bend the bottom wall along line 14 to deflect the two segments 12*a* and 12*b* outwardly away from one another and thereby render the moulded container nestable with the plurality of like containers as illustrated in FIG. 4.

Preferably, the container is moulded to the nestable configuration in which the segments assume the position shown in FIG. 1 so that it is not necessary to fold the containers along the flex line 14 after their production in order to achieve the nesting characteristic.

In order to arrange the bottom and side walls of the container in the required container configuration illustrated in FIG. 2 of the drawings, the bottom wall is flexed along the flex line 14 to a flat configuration and the tabs 24*a* and 24*b* are secured by means of an adhesive or the like to the end walls 18*b* and 18*a*, respectively. By securing the tabs of one container portion to the side wall of the other container portion, the container is retained in the container configuration with a flat bottom wall. After the container is loaded the top panels 28*a*, 30*a*, 28*b* and 30*b* are folded over and interwoven to assume the position shown in FIG. 3 of the drawings.

Figure 4:
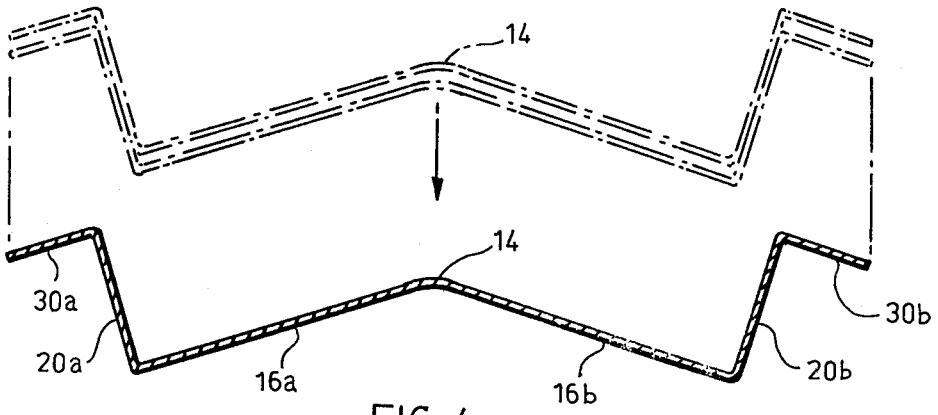
FIG. 4 is sectional view along the line 4—4 of FIG. 1 which also illustrates in broken lines a number of like containers arranged in a nested configuration.

As illustrated in FIG. 4 of the drawings, by reason of the fact that the bottom wall segments 16*a* and 16*b* are inclined outwardly and downwardly away from one another along the flex line 14, it is possible to stack a number of similar container blanks one on top of the other in a nested configuration.

The container is, as previously indicated, preferably moulded in the configuration illustrated in FIGS. 1 and 4 of the drawings in which the two container segments are disposed in an outwardly inclined relationship along the flex line 14. This configuration permits the ready withdrawal of the moulded article from the mould and it enables the mould halves to be constructed in a manner which facilitates opening of the mould and the removal of the moulded article from the mould by permitting all of the walls to assume an appropriate draw angle.

The containers which are formed according to the present invention may be moulded containers made from wood pulp or plastic material. When made from wood pulp, the containers may be moulded in the outwardly flexed configuration to facilitate unmoulding and immediately after their removal from the mould, the containers may be located with the bottom wall thereof resting flat against a drying support. Thus, the container may be deflected to the flat bottom configuration before it is dryed and may dry in the flat configuration. As a result, when this container is flexed outwardly for nesting purposes, it will tend to return to the flat configuration when removed from the nesting relationship and this characteristic serves to facilitate the final assembly of the container.

Various modifications of the present invention will be apparent to those skilled in the art. In the preferred embodiment, the sidewalls are defined as being vertically oriented with respect to the bottom wall. It will be understood that this preferred relationship is discussed merely to illustrate that a container having this characteristic may be provided by means of the present invention. The sidewalls may, however, be angularly inclined with respect to the bottom wall, thereby, to provide an included angle between the side wall and the bottom wall of more or less than ninety degrees as required in use. It will also be understood that the flexibility which is achieved along the flex line may be an inherent characteristic of the material which is moulded or it may be achieved by effecting a weakening of the bottom wall along the flex line. It will be understood that the flexing or hinging may occur along a clearly defined sharp line, if the wall is locally weakened along a clearly defined line. If there is no clearly defined line of weakening, the flexing may occur along a gentle arc of curvature extending between opposite ends of the segment of the bottom which is to be deflected outwardly.

These and other advantages of the present invention will be apparent to those skilled in the art.

What I claim as my invention is:

1. A rectangular integrally moulded container comprising, two container portions, each container portion consisting of a triangular bottom wall segment and two side walls formed in upstanding relationship with respect to the bottom wall segment and joined at an upstanding rigid corner, the bottom wall segments of the container portions being joined along a hinge line which extends diagonally between the two other corners of the container across the bottom thereof; a tab integrally connected to one of the side walls of the container at each of said other corners and bendable to overlie and join the side wall of the opposite container portion at that corner; and top wall members hingedly connected to side walls of both segments and hingeable to overlie the container, the container having a first configuration in which it is moulded and in which the bottom wall segments are mutually inclined to dispose the side walls of the two container portions in a divergent relationship to facilitate removal from the mould and subsequent nesting of containers, and having a second configuration for a set-up container in which the bottom wall segments are coplanar and the side walls of the two portions meet and are joined by the tabs at the ends of the hinge line to make said other corners rigid.

* * * * *